US006966768B2

(12) United States Patent
Holler

(10) Patent No.: US 6,966,768 B2
(45) Date of Patent: Nov. 22, 2005

(54) FLAME THROWING APPARATUS AND ASSOCIATED METHODS

(76) Inventor: Christopher A. Holler, 2449 Via Sienna Ave., Winter Park, FL (US) 32789

( * ) Notice: Subject to any disclaimer, the term of this patent is extended or adjusted under 35 U.S.C. 154(b) by 296 days.

(21) Appl. No.: 10/274,724

(22) Filed: Oct. 21, 2002

(65) Prior Publication Data

US 2004/0076915 A1 Apr. 22, 2004

(51) Int. Cl.[7] ..... F41H 9/02
(52) U.S. Cl. ..... 431/91
(58) Field of Search ..... 431/91

(56) References Cited

U.S. PATENT DOCUMENTS

| | | | | |
|---|---|---|---|---|
| 1,220,103 A | | 3/1917 | Hall | |
| 1,340,012 A | | 5/1920 | Cave et al. | |
| 2,147,981 A | | 2/1939 | Graham | |
| 2,417,981 A | * | 3/1947 | Graham | 431/91 |
| 2,601,893 A | * | 7/1952 | Funke | 431/91 |
| 2,952,309 A | * | 9/1960 | Fay | 431/91 |
| 2,971,573 A | | 2/1961 | Griffin et al. | |
| 3,034,568 A | | 5/1962 | Fowler et al. | |
| 3,106,238 A | | 10/1963 | Bruce | |
| 3,844,449 A | | 10/1974 | Alter | |
| 3,880,569 A | | 4/1975 | Bannister et al. | |
| 4,395,227 A | | 7/1983 | Stivers | |
| 5,429,494 A | | 7/1995 | Kuehn | |
| 5,860,243 A | | 1/1999 | Stager | |
| 6,059,562 A | | 5/2000 | Anderson, II | |
| 6,171,098 B1 | | 1/2001 | Meyer et al. | |

* cited by examiner

*Primary Examiner*—Alfred Basichas
(74) *Attorney, Agent, or Firm*—The Torpy Group, P.L.

(57) ABSTRACT

A flame throwing apparatus includes a handheld frame, a fluid container carried by the frame for containing a flammable fluid, a disposable propellant container, and a disposable propellant container receiver carried by the frame and connected to the fluid container for removably receiving the disposable propellant container, and supplying propellant to the fluid container. A nozzle assembly may be carried by the frame, and may include an extraction tube extending into the fluid container, a control valve connected to the extraction tube, a nozzle connected to the control valve, and an igniter adjacent the nozzle.

27 Claims, 5 Drawing Sheets

FLAME THROWING APPARATUS AND ASSOCIATED METHODS

FIELD OF THE INVENTION

The present invention relates to the field of flame throwers, and, more particularly, to the field of handheld flame throwers, and associated methods.

BACKGROUND OF THE INVENTION

Flame throwers have been used in the past for many different applications, ranging from military operations to firefighting. Traditional flame throwers include a large fluid container for containing a flammable fluid, and a large propellant container for containing a propellant. The propellant is used to selectively dispense the fuel through a nozzle. The fluid and propellant containers are generally connected to a frame which is then carried on a user's back. In other words, the fluid and propellant containers are generally in the form of a back pack unit, which may be cumbersome in many applications.

Such a flame thrower is disclosed in U.S. Pat. No. 1,340,012 to Cave et al. The flame thrower includes a pair of fuel containers carried by a frame, and a propellant container also carried by the frame between the pair of fuel containers. The frame is carried on the users back in a back pack configuration. A valve adjacent the top of the fuel containers on the frame (behind the user) must first be manually opened to operate the flame thrower. A nozzle is in fluid communication with the fuel containers and is carried by the user. This configuration may be disadvantageous, however, due to its large size and complicated operation. Exposure of the large fuel containers having flammable fluid therein may pose a risk to the user.

Another such flame thrower is disclosed in U.S. Pat. No. 3,844,449 to Alter. The flame thrower also includes a fuel container, and a propellant container carried by a frame. The propellant container is perpendicular to the fluid container. A valve adjacent the bottom of the fluid container (behind the user) must be manually opened to operate the flame thrower. Again, this configuration may be disadvantageous due to its large size and complicated operation. Further, the exposure of the large fluid container may pose a risk to the user.

A one-shot flame thrower is disclosed in U.S. Pat. No. 3,034,568 to Fowler et al. The flame thrower includes a U-shaped fuel container having a piston for pressurizing flammable fluid therein. A rupture cap is included between the end of the fuel container and a nozzle hose. The fuel container is pressurized and the rupture cap breaks to release the flammable fluid. Accordingly, the rupture cap must be replaced after every use. The flame thrower may be complicated to use, and costly when used more than once.

SUMMARY OF THE INVENTION

In view of the foregoing background, it is therefore an object of the present invention to provide a flame throwing apparatus and associated method that is simple to use, compact and readily reusable.

This and other objects, features and advantages of the present invention are provided by a handheld flame throwing apparatus that may include a handheld frame, a fluid container carried by the frame for containing a flammable fluid, and a disposable propellant container. A disposable propellant container receiver may be carried by the frame and connected to the fluid container for removably receiving the disposable propellant container and supplying propellant to the fluid container. A nozzle assembly may also be carried by the frame, and may include an extraction tube extending into the fluid container, a control valve connected to the extraction tube, a nozzle connected to the control valve, and an igniter adjacent the nozzle. The handheld flame throwing apparatus is advantageously cost effective, lightweight, compact, and readily reusable.

The handheld flame throwing apparatus may further comprise a handle connected to the fluid container, an actuator bar having a first end connected to the control valve, and a second end, and a handle lever pivotally carried by the handle and in contact with the second end of the actuator bar so that operation of the handle lever may operate the control valve between opened and closed positions. This configuration advantageously allows the control valve to be readily opened and closed by a user when desired. The igniter may include a battery, and a spark generator connected to the battery adjacent the nozzle to emit a spark to ignite the flammable fluid.

The propellant container receiver may include a threaded connector and the propellant container may include a threaded valve so that the propellant container may be connected to the propellant container receiver by connecting the threaded valve to the threaded connector. The fluid container may further comprise a fluid container plug so that the fluid container can be refilled. Accordingly, the flame throwing apparatus may advantageously be readily reused by simply replacing the disposable propellant container and refilling the fluid container with flammable fluid.

The flammable material may comprise gasoline, and the propellant may comprise propane, for example. The fluid container may further have a storage capacity between about ½ and 2 gallons and may be made of polyvinyl chloride (PVC). The control valve may comprise at least one of a stop valve, a check valve, and a ball valve.

A method aspect of the present invention is for using a flame throwing apparatus. The method may comprise filling the fluid container with a flammable fluid, connecting the disposable propellant container to the handheld frame and the fluid container, supplying the flammable fluid from the fluid container through a nozzle assembly carried by the frame, and selectively operating an igniter to ignite the flammable fluid as it is supplied from the fluid container.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
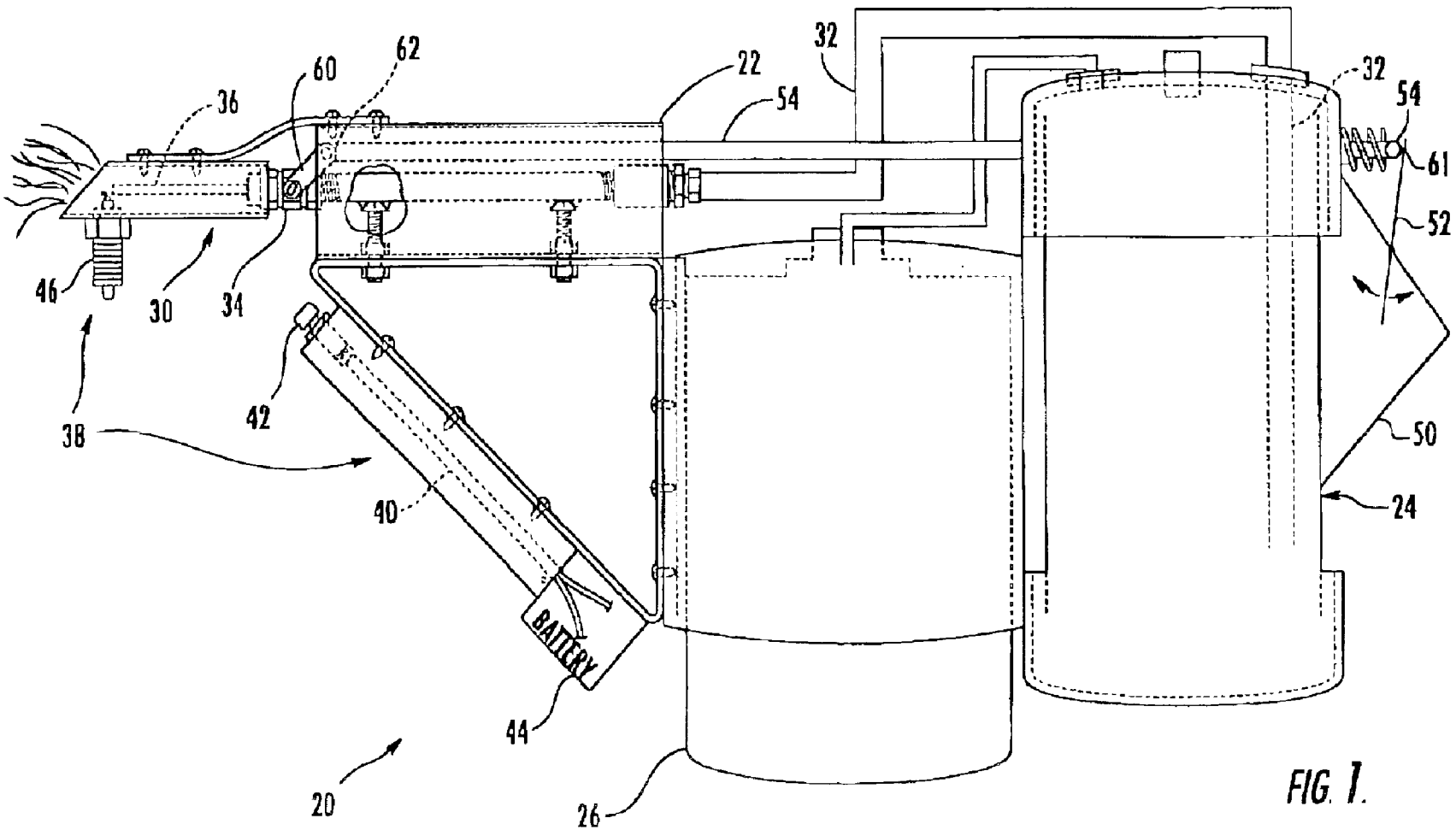
FIG. 1 is a perspective view of a flame throwing apparatus according to the present invention.

Referring initially to FIG. 1, a handheld flame throwing apparatus 20 according to the present invention is now described. The handheld flame throwing apparatus 20 illustratively comprises a handheld frame 22 and a fluid container 24 carried by the frame for containing a flammable fluid. The flammable fluid may, for example, be gasoline, or any other fluid having similar flammable properties, as understood by those skilled in the art. The handheld flame throwing apparatus 20 further illustratively includes a disposable propellant container 26 for containing a propellant. The propellant may be propane, for example, and the disposable propellant container 26 may be a disposable propane tank, as commonly used in camping applications, for example, or another type of disposable container having a propellant therein, as understood by those skilled in the art. This arrangement facilitates reuse of the handheld flame throwing apparatus 20 by simply refilling the fluid container 24 and replacing the disposable propellant container 26.

A disposable propellant container receiver 28 is illustratively carried by the handheld frame 22 and connected to the fluid container 24. The disposable propellant container receiver 28 illustratively removably receives the disposable propellant container 26 and supplies the propellant to the fluid container 24.

A nozzle assembly 30 is illustratively carried by the frame 22. The nozzle assembly 30 includes an extraction tube 32 extending into the fluid container 24, a control valve 34 connected to the extraction tube, a nozzle 36 connected to the control valve, and an igniter 38 adjacent the nozzle. The control valve 34 may, for example, be a stop valve, a check valve, a gate valve, a ball valve, or any other type of valve as understood by those skilled in the art. The control valve 34 may include a threaded receiving portion and an end of the nozzle 36 may also be threaded so as to provide a threaded connection between the nozzle and the control valve.

The igniter 38 illustratively comprises a battery 22, and a spark generator 46 connected to the battery adjacent the nozzle 36 to emit a spark to ignite the flammable fluid. More specifically, the igniter 38 may include an ignition capacitor 40, a switch 42 connected to the ignition capacitor, and a battery 44 connected to the switch. The spark generator 46 may include a spark plug connected to the battery adjacent the nozzle 36. The spark plug emits a spark to ignite a stream of the flammable material as it is dispensed out of the nozzle 36. Although a spark plug is illustrated, any other type of device capable of emitting a spark or flame to ignite the stream of flammable fluid may also be used, as understood by those skilled in the art.

Figure 2:
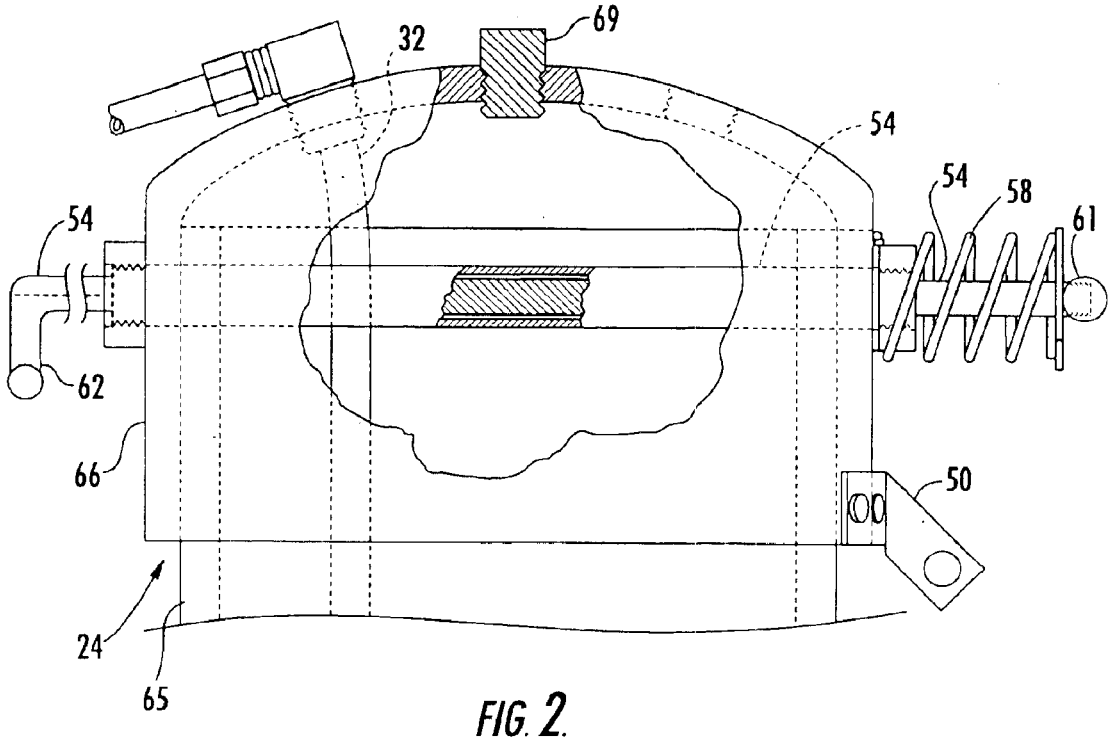
FIG. 2 is a side view of a fluid container of the flame throwing apparatus shown in FIG. 1 having portions cut away for clarity.
Figure 3:
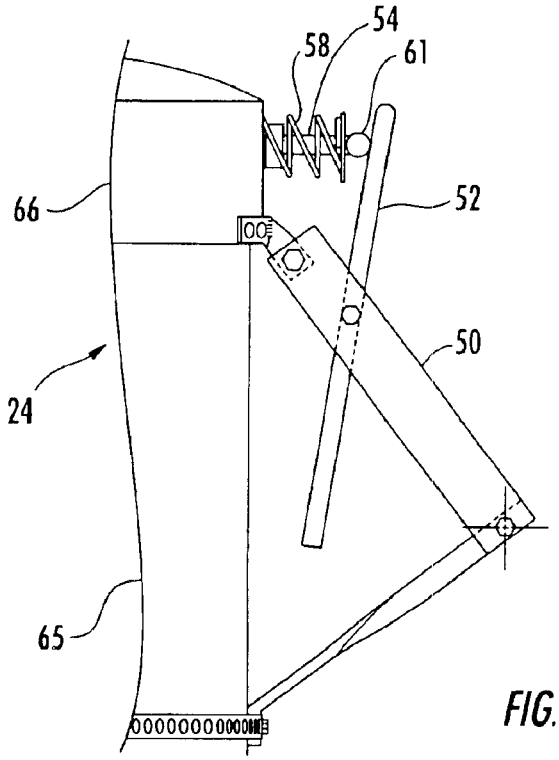
FIG. 3 is a partial side view of the fluid container shown in FIG. 2.

Turning now additionally to FIGS. 2–3, the fluid container 24 of the flame throwing apparatus 20 is now described in greater detail. A handle 50 is illustratively connected to a side of the fluid container 24. An actuator bar 54 illustratively extends through the fluid container 24 and is ultimately connected to the control valve 34. A handle lever 52 is illustratively pivotally connected to the handle 50. The handle lever 52 is pivoted to an on position to engage the actuator bar 54, which, in turn, opens the control valve 34 to release the stream of flammable fluid. To close the control valve 34, the handle lever 52 is pivoted to an off position.

The actuator bar 54 illustratively includes a first end 61 adjacent the handle lever 52, and a second end 62 that connects to the control valve 34. The first end 61 of the actuator bar 54 may be T-shaped. The T-shape advantageously provides better contact between the first end 61 of the actuator bar 54 and the handle lever 52. A spring 58 is illustratively connected to the actuator bar 54 between the first end 61 and the fluid container 24. The spring 58 advantageously urges the actuator bar 54 to return to the off position after the handle lever 52 is released. The second end 62 of the actuator bar 54 is illustratively L-shaped. The control valve 34 illustratively includes a control valve lever 60 (FIG. 1) connected thereto for moving the control valve between opened and closed positions. The control valve lever 60 has an actuator bar receiving passageway formed therein. The second end 62 of the actuator bar 54 illustratively matingly engages the actuator bar receiving passageway so that the handle lever 52 may be used to open and close the control valve 34.

The handle 50 and handle lever 52 may comprise aluminum, for example, or another type of metal, or plastic, that is lightweight and has high strength, as understood by those skilled in the art. Likewise, the frame 22 may also comprise aluminum to advantageously provide a lightweight flame throwing apparatus 20. The handle 50 may be mounted to the fluid container 24 using screws along an upper portion of the handle, for example, or another type of fastener. A lower portion of the handle 50 may be fastened to a lower portion of the fluid container 24 using screws as well. A hose clamp, for example, may also be fastened around lower portions of the fluid container 24 and handle 50 for additional stability. The handle lever 52 is illustratively pivotally connected to the handle 50 using a fastener, such as a bolt and nut combination, for example.

The fluid container 24 may comprise polyvinyl chloride (PVC), for example. More particularly, the fluid container 24 may include a medial cylindrical body 65 and a pair of covers 66. The pair of covers 66 may include an upper cover and a lower cover (FIG. 1). The medial cylindrical body 65 may comprise a 4-inch diameter schedule 40 PVC pipe, for example, and the pair of covers 66 may comprise 4-inch diameter schedule 40 PVC caps, as understood by those skilled in the art. The upper cover may include a plug receiving passageway formed therein and a fluid container plug 69 received in the plug receiving passageway. The plug receiving passageway and the fluid container plug 69 are illustratively threaded so that the fluid container plug 69 may be readily removed to refill the fluid container 24 with flammable fluid. The fluid container 24 preferably has a capacity between the range of about ½ to 2 gallons, but other capacities may be provided according to the size of the PVC pipe and caps used for the respective medial body 65 and covers 66, as understood by those skilled in the art.

Figure 4:
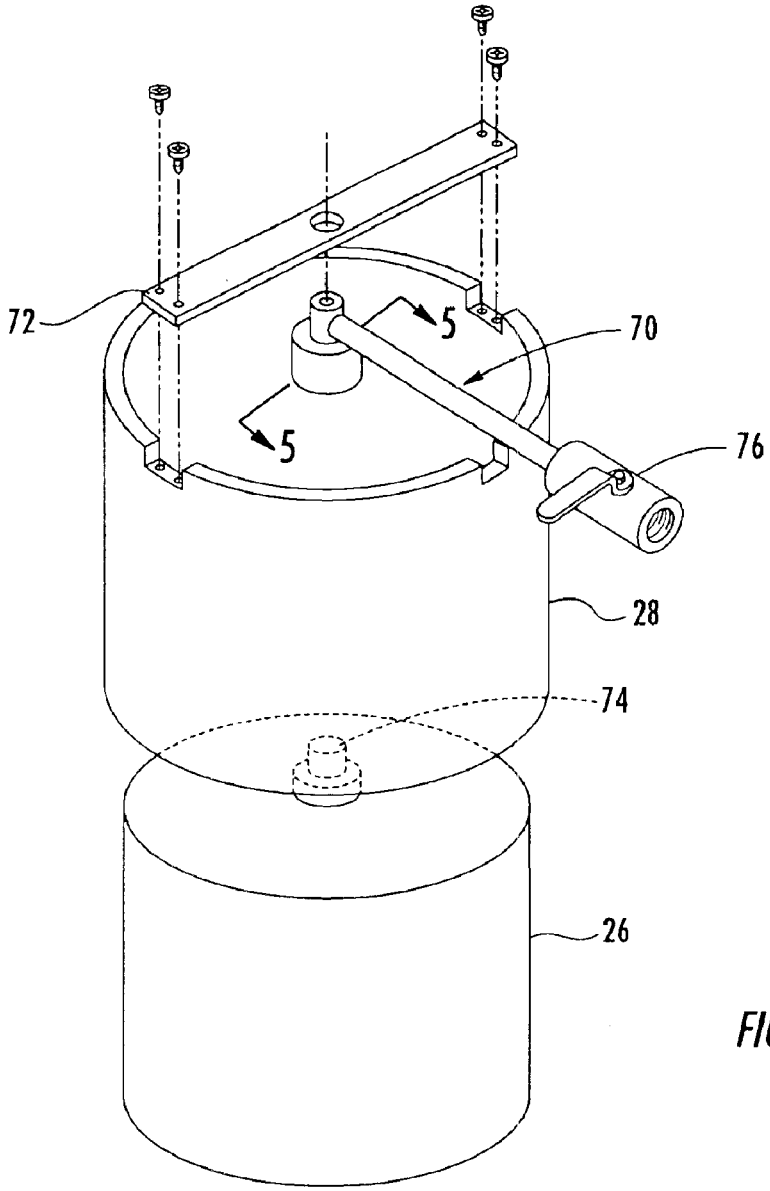
FIG. 4 is an exploded perspective view of a propellant container receiver receiving a disposable propellant container according to the present invention.
Figure 5:
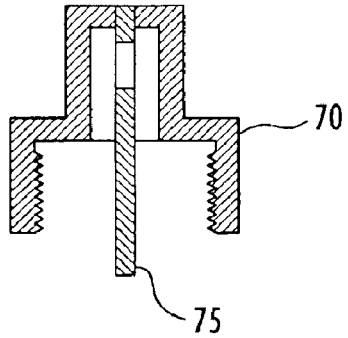
FIG. 5 is a cross sectional view of a threaded connector through line 5—5 in FIG. 4.

Turning now additionally to FIGS. 4–5, the propellant container receiver 28 and the propellant container 26 are now described in more detail. The propellant container receiver 28 preferably comprises a 4-inch diameter schedule 40 PVC pipe, as understood by those skilled in the art. More specifically, the propellant container receiver 28 may be about 5 inches long and open along a bottom portion thereof to receive the disposable propellant container 26. The propellant container receiver 28 is preferably fastened to the frame 22 using screws, for example. A threaded connector 70 illustratively extends through a top portion of the propellant container receiver 28. A connector bar 72 illustratively fastens the threaded connector 70 to the top portion of the propellant container receiver 28. The threaded portion of the threaded connector 70 preferably extends to an interior portion of the propellant container receiver 28, i.e., through a top portion thereof.

The disposable propellant container 26 illustratively includes a threaded valve 74 along a top portion thereof. The threaded valve 74 of the propellant container 26 may illustratively be connected to the threaded connector 70 so that the disposable propellant container may be readily connected and disconnected from the propellant container receiver 28. The disposable propellant container 26 may advantageously be provided by a typical disposable propane container as described above.

As perhaps best illustrated in FIG. 5, the threaded connector 70 illustratively includes a valve pin 75 that engages the threaded valve 74 of the disposable propellant container 26. A propellant valve 76 is illustratively connected to the threaded connector 70 to control flow of the propellant. The propellant valve 76 may be switched between opened and closed positions to control the flow of the propellant from the disposable propellant container 26 to the fluid container 24 as desired.

Figure 6:
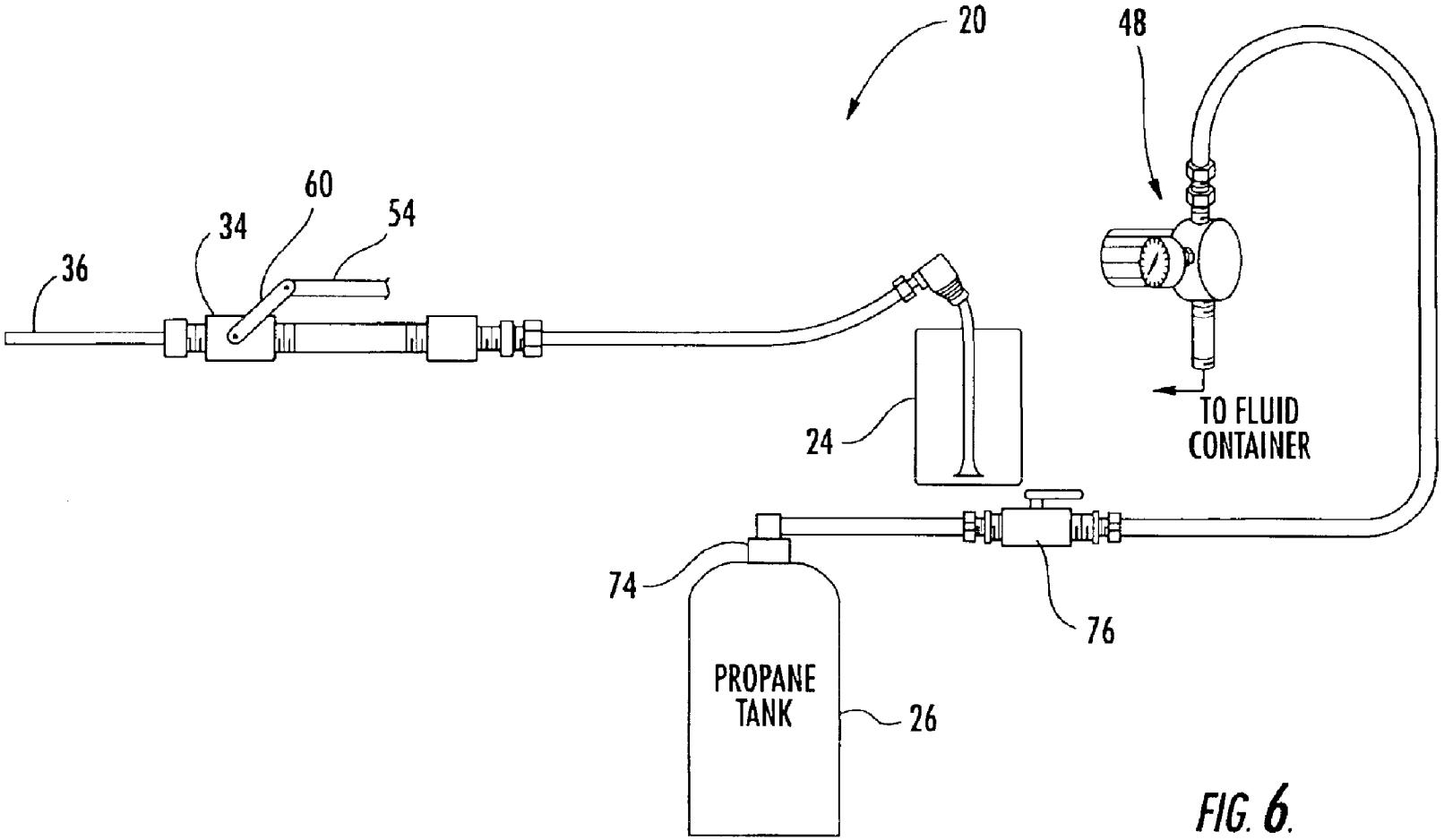
FIG. 6 is a plumbing schematic of a flame throwing apparatus according to the present invention.

Turning now additionally to FIG. 6, a plumbing schematic is illustrated to describe operation of the flame throwing apparatus 20. The propellant valve 76 may be opened to begin the flow of propellant from the propellant container 26 to the fluid container 24. The actuator bar 54 may then be activated to operate the control valve 34 and release the flammable fluid from the fluid container 24. Upon operation of the control valve 34, the flammable fluid is commuted to the nozzle 36. A switch 42 on the handle 50 (FIG. 1) may be activated to emit a spark from a spark plug. The spark ignites the stream of flammable fluid being emitted from the nozzle 36 to produce an ignited stream of flammable fluid. To stop the ignited stream of flammable fluid, the user may simply release the handle lever 52 to thereby close the control valve 34. In some embodiments, an optional pressure control valve apparatus 48 may be connected to the fluid container 24 to adjust and monitor pressure within the fluid container.

The ignited stream of flammable fluid is preferably projected for a distance between the range of about 30 to 80 feet and may last between 20 and 100 seconds. Of course, those skilled in the art will recognize that the distance of the ignited stream and the duration of the ignited stream is dependent upon the capacity of the fluid container 24 and the disposable propellant container 26.

Figure 7:
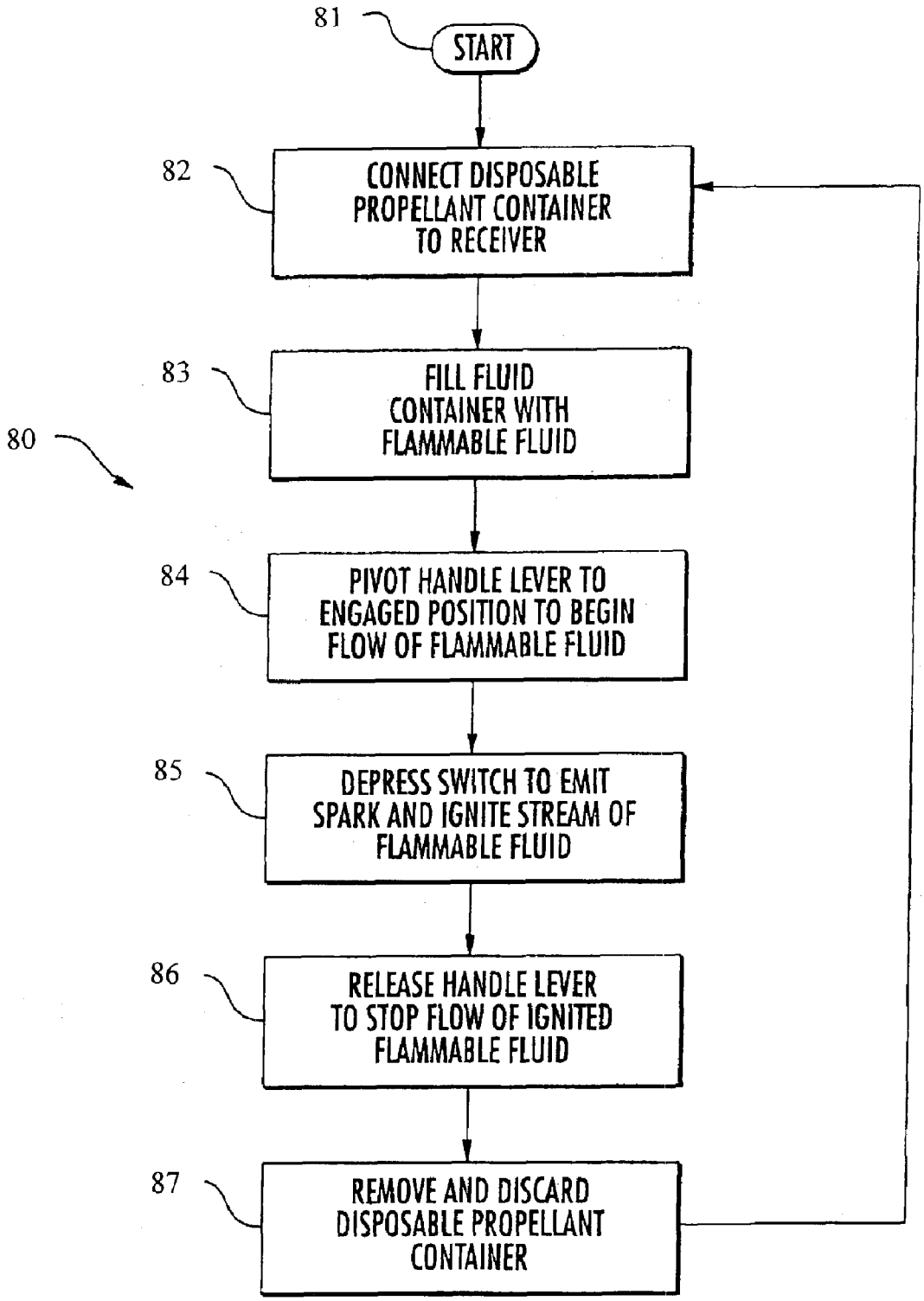
FIG. 7 is a flow chart illustrating a method of using the flame throwing apparatus according to the present invention.

Turning now more particularly to the flow chart 80 of FIG. 7, a method of using the flame throwing apparatus 20 is now described. From the start (Block 81), the disposable propellant container 26 is connected to the propellant container receiver 28 at Block 82. At Block 83, the fluid container 24 is filled with flammable fluid. The handle lever 52 is pivoted to open the control valve 34 and begin the flow of the flammable fluid at Block 84. At Block 85, the switch 42 is depressed to emit a spark from the spark generator 46 and ignite the steam of flammable fluid. At Block 86, the handle lever 52 is released to stop the flow of ignited flammable fluid. The disposable propellant container 26 is removed and discarded at Block 87. The method can again be repeated by connecting another disposable propellant container 26 to the propellant container receiver 28 at Block 82.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A handheld flame throwing apparatus comprising:

a handheld frame;

a fluid container carried by said frame for containing a flammable fluid;

a disposable propellant container;

a disposable propellant container receiver carried by said frame and connected to said fluid container for removably receiving said disposable propellant container and supplying propellant to said fluid container; and a nozzle assembly carried by said frame comprising
an extraction tube extending into said fluid container,
a control valve connected to said extraction tube,
a nozzle connected to said control valve, and
an igniter adjacent said nozzle;

said fluid container, disposable propellant container, disposable propellant container receiver and nozzle assembly all being carried by said handheld frame so that the handheld flame throwing apparatus is self-contained.

2. A handheld flame throwing apparatus according to claim 1 further comprising a handle connected to said fluid container; an actuator bar having a first end connected to said control valve, and a second end; and a handle lever pivotally carried by said handle and in contact with the second end of said actuator bar so that operation of the handle lever operates said control valve between an opened and a closed position.

3. A handheld flame throwing apparatus according to claim 1 wherein said igniter comprises:

a battery; and a spark generator connected to said battery adjacent the nozzle to emit a spark to ignite the flammable fluid.

4. A handheld flame throwing apparatus according to claim 1 wherein said propellant container receiver includes a threaded connector and said disposable propellant container includes a threaded valve so that said disposable propellant container receiver by connecting the threaded valve to the threaded connector.

5. A handheld flame throwing apparatus according to claim 1 wherein said fluid container further comprises a fluid container plug so that said fluid container can be refilled.

6. A handheld flame throwing apparatus according to claim 1 wherein the flammable fluid comprises gasoline.

7. A handheld flame throwing apparatus according to claim 1 wherein the propellant comprises propane.

8. A handheld flame throwing apparatus according to claim 1 wherein said fluid container further has a fluid storage capacity between about ½ and 2 gallons.

9. A handheld flame throwing apparatus according to claim 1 wherein said fluid container comprises polyvinyl chloride (PVC).

10. A handheld flame throwing apparatus according to claim 1 wherein said control valve comprises at least one of a stop valve, a check valve, a gate valve, and a ball valve.

11. A handheld flame throwing apparatus comprising:

a handheld flame;

a fluid container carried by said frame for containing a flammable fluid;

a disposable propellant container carried by said frame and connected to said fluid container for supplying propellant to said fluid container; and a nozzle assembly carried by said frame for extracting the flammable fluid from said fluid container, igniting said flammable fluid, and emitting an ignited stream of flammable fluid;

said fluid container, disposable propellant container and nozzle assembly all being carried by handheld frame so that said handheld flame throwing apparatus is self-contained.

12. A handheld flame throwing apparatus according to claim 11 further comprising a propellant container receiver carried by said frame and connected to said fluid container for removably receiving said disposable propellant container.

13. A handheld flame throwing apparatus according to claim 11 wherein said nozzle assembly further comprises:

an extraction tube extending into said fluid container;

a control valve connected to said extraction tube;

a nozzle connected to said control valve; and an igniter adjacent said nozzle.

14. A handheld flame throwing apparatus according to claim 13 further comprising a handle connected to said fluid container; an actuator bar having a first end connected to said control valve, and a second end; and a handle lever pivotally carried by said handle and in contact with the second end of said actuator bar so that operation of the handle lever operates said control valve between an opened and a closed position.

15. A handheld flame throwing apparatus according to claim 13 wherein said igniter comprises;

a battery; and a spark generator connected to said battery adjacent the nozzle to emit a spark to ignite the flammable fluid.

16. A handheld flame throwing apparatus according to claim 12 wherein said propellant container receiver includes a threaded connector and said disposable propellant container includes a threaded valve so that said disposable propellant container is removably connected to said propellant container receiver by connecting the threaded valve to the threaded connector.

17. A handheld flame throwing apparatus according to claim 11 wherein said fluid container further comprises a fluid container plug so that said fluid container can be refilled.

18. A handheld flame throwing apparatus according to claim 11 wherein said fluid container further has a storage capacity between about ½ and 2 gallons.

19. A handheld flame throwing apparatus according to claim 13 wherein said control valve comprises at least one of a stop valve, a check valve, a gate valve, and a ball valve.

20. A handheld flame throwing apparatus according to claim 13 wherein said control valve comprises at least one of a stop valve, a check valve, a gate valve, and a ball valve.

21. A method of using a handheld flame throwing apparatus comprising:

filling a fluid container connected to a handheld frame with a flammable fluid;

connecting a disposable propellant container containing propellant to the handheld frame and the fluid container;

supplying the flammable fluid from the fluid container through a nozzle assembly carried by the handheld frame, the fluid container, disposable propellant container and nozzle assembly all being carried by the handheld frame so that the handheld flame throwing apparatus is self-contained; and selectively operating an igniter to ignite the flammable fluid as it is supplied from the fluid container.

22. A method according to claim 21 further comprising extending an extraction tube into the fluid container to extract the flammable fluid from the fluid container.

23. A method according to claim 22 further comprising opening a control valve connected to the extraction tube by engaging a hand lever to propel the flammable fluid from the fluid container.

24. A method according to claim 22 further comprising closing the control valve by disengaging the hand lever.

25. A method according to claim 22 further comprising igniting the flammable fluid by engaging a spark generator to emit a spark adjacent the flammable fluid as it is emitted from the nozzle assembly.

26. A method according to claim 21 further comprising filling the first container with about ½ to 2 gallons of flammable fluid.

27. A method according to claim 21 further comprising replacing a used disposable propellant container with another disposable propellant container filled with propellant.

* * * * *